US008011396B1

(12) United States Patent
Harvey

(10) Patent No.: US 8,011,396 B1
(45) Date of Patent: Sep. 6, 2011

(54) MULTIPURPOSE FUNNEL SYSTEM

(76) Inventor: Travis Carl Harvey, Upper Chichester, PA (US)

( * ) Notice: Subject to any disclaimer, the term of this patent is extended or adjusted under 35 U.S.C. 154(b) by 0 days.

(21) Appl. No.: 13/012,131

(22) Filed: Jan. 24, 2011

Related U.S. Application Data

(63) Continuation of application No. 11/712,755, filed on Mar. 1, 2007, now Pat. No. 7,874,326.

(51) Int. Cl.
*B65B 39/00* (2006.01)

(52) U.S. Cl. ..... 141/330; 141/335; 141/340; 222/66

(58) Field of Classification Search ..... 141/1, 2, 141/312, 319, 329–345; 222/83–86, 472
See application file for complete search history.

(56) References Cited

U.S. PATENT DOCUMENTS

| | | | | |
|---|---|---|---|---|
| 4,202,386 | A | 5/1980 | Orr | 141/300 |
| 4,705,192 | A | 11/1987 | Knapton | 222/144.5 |
| 5,228,488 | A | 7/1993 | Fletcher | 141/331 |
| 5,787,944 | A | 8/1998 | Sarkis | 141/300 |
| 6,142,193 | A | 11/2000 | Sanders | 141/300 |
| 7,237,582 | B1 | 7/2007 | Harvey | 141/330 |
| 7,284,581 | B2 | 10/2007 | Steinweg | 141/340 |
| 7,874,326 | B1 * | 1/2011 | Harvey | 141/330 |

* cited by examiner

*Primary Examiner* — Timothy L Maust
(74) *Attorney, Agent, or Firm* — Janine D. Geraigery; Law Offices of J. D. Geraigery

(57) ABSTRACT

An improved multipurpose funnel system for filling a container, which prevents liquid from overflowing, is self venting and is capable of filling hard to reach container locations. The system has a funnel removably coupled to a bottle cartridge which holds bottles therein. A pair of parallel rods hingedly connected to the bottle cartridge and having at least one hollow cone shaped spike extending outwardly therefrom. The funnel has a downspout having venting tubes, and a cap having an elongated threaded tip. The cap and downspout each include semi-circular plates which work in conjunction together as a check valve mechanism for controlling the flow of liquid therethrough. The check valve mechanism includes a closed first position, intermediate second position, and opened third position.

14 Claims, 2 Drawing Sheets

MULTIPURPOSE FUNNEL SYSTEM

CROSS REFERENCES AND RELATED SUBJECT MATTER

This application is a continuation of patent application Ser. No. 11/712,755, filed in the United States Patent Office on Mar. 1, 2007 now U.S. Pat. No. 7,874,326.

BACKGROUND OF THE INVENTION

The invention relates to a funnel, and more particularly, to an improved multipurpose funnel system for filling a container which prevents overflow during filling, is self venting and is capable of filling hard to reach container locations.

It is not always easy to determine when, or if, major repairs, perhaps even a complete overhaul is required for an automobile truck or engine. High mileage is not necessarily an indication that engine work is needed, just as low mileage does not preclude the need for maintenance action. An engine that undergoes regular and frequent oil changes, as well as other required maintenance, will most likely provide many thousands of miles of reliable service. Conversely, a neglected engine may require an overhaul very early in life.

Most motorists realize the need to check the oil on a frequent basis to ensure that the oil level is sufficient to supply the required amount of lubricating oil to the engine. Additionally, manufacturers recommend that oil be changed every 3,000 miles or so. Whenever oil is added to an engine, the oil cap must be removed and, ideally, a funnel inserted into the oil filler opening to prevent oil from spilling onto the engine block and the area beneath the engine block. The funnels that are used for this purpose are manually positioned in the oil fill opening, after the cap has been removed, and a bottle of oil poured into the funnel. The bottle must be held in until all of the oil has been poured. Most automotive vehicles require four or five quarts of oil, depending on the size of the engine, when the filter is replaced, and each quart bottle of oil must be held until the last bottle is emptied. This is not an overly demanding task, physically, but it is a time consuming task.

U.S. Pat. No. 4,202,386 to Orr discloses a funnel for use in filling containers with liquid and designed to prevent overflowing of the container during filling.

U.S. Pat. No. 5,787,944 to Sarkin et al. discloses a self venting funnel that automatically vents air from a system or container while a fluid or solid material is being introduced therein.

U.S. Pat. No. 6,142,193 to Sanders discloses a self venting multipurpose funnel having a plurality of sections of varying diameter.

While these units may be suitable for the particular purpose employed, or for general use, they would not be as suitable for the purposes of the present invention as disclosed hereafter.

SUMMARY OF THE INVENTION

It is an object of the invention to produce a funnel which can access hard to reach containers. Accordingly, the invention is a multipurpose funnel system including a funnel and a bottle cartridge, wherein the funnel has an elongated tip which allows access to hard to reach containers.

It is another object of the invention to provide a funnel capable of securely interlocking with a bottle cartridge. Accordingly, the bottle cartridge includes interlocking tabs, and the funnel includes a downspout having a top having interlocking notches, wherein the interlocking tabs secure to the interlocking notches for conveniently securing the bottle cartridge to the funnel.

It is another object of the invention to provide a means for regulating the flow of a fluid through the funnel system. Accordingly, the present invention includes a control valve mechanism made up of components in both the downspout and cap which work together to regulate the flow of liquid.

It is another object of the invention to provide a funnel capable of filling containers which prevents overflow of the container during filling. Accordingly, the funnel of the invention includes a downspout and a cap, each having a semi-circular plate, the plates rotate in conjunction with one another as a check valve mechanism, selectively controlling the speed and flow of liquid therethrough.

It is another object of the invention to provide a convenient means for self venting the funnel. Accordingly, the invention includes a plurality of venting tubes adjacent the downspout which allow air caught therein to escape and result in the faster flow of liquid therethrough.

It is another object of the invention to provide a means for allowing liquid to drain from a bottle into a container more quickly. Accordingly, the present invention includes rods which hold inverted bottles of liquid in position within the bottle cartridge and said rods have cone shaped spikes which puncture the bottles, thereby allowing liquid to drain from the bottle into the container more quickly.

It is yet another object of the invention to provide a means for allowing a user to easily grasp and tightening and loosen the cap onto a valve cover or oil fill locations. Accordingly, the cap of the invention includes a curved lip which provides a grasping means for grasping means for tightening and loosening the cap.

This invention is an improved multipurpose funnel system for filling a container, which prevents liquid from overflowing, is self venting and is capable of filling hard to reach container locations. The system has a funnel removably coupled to a bottle cartridge which holds bottles therein. A pair of parallel rods hingedly connected to the bottle cartridge and having at least one hollow cone shaped spike extending outwardly therefrom. The funnel has a downspout having venting tubes, and a cap having an elongated threaded tip. The cap and downspout each include semi-circular plates which work in conjunction together as a check valve mechanism for controlling the flow of liquid therethrough. The check valve mechanism includes a closed first position, intermediate second position, and opened third position.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
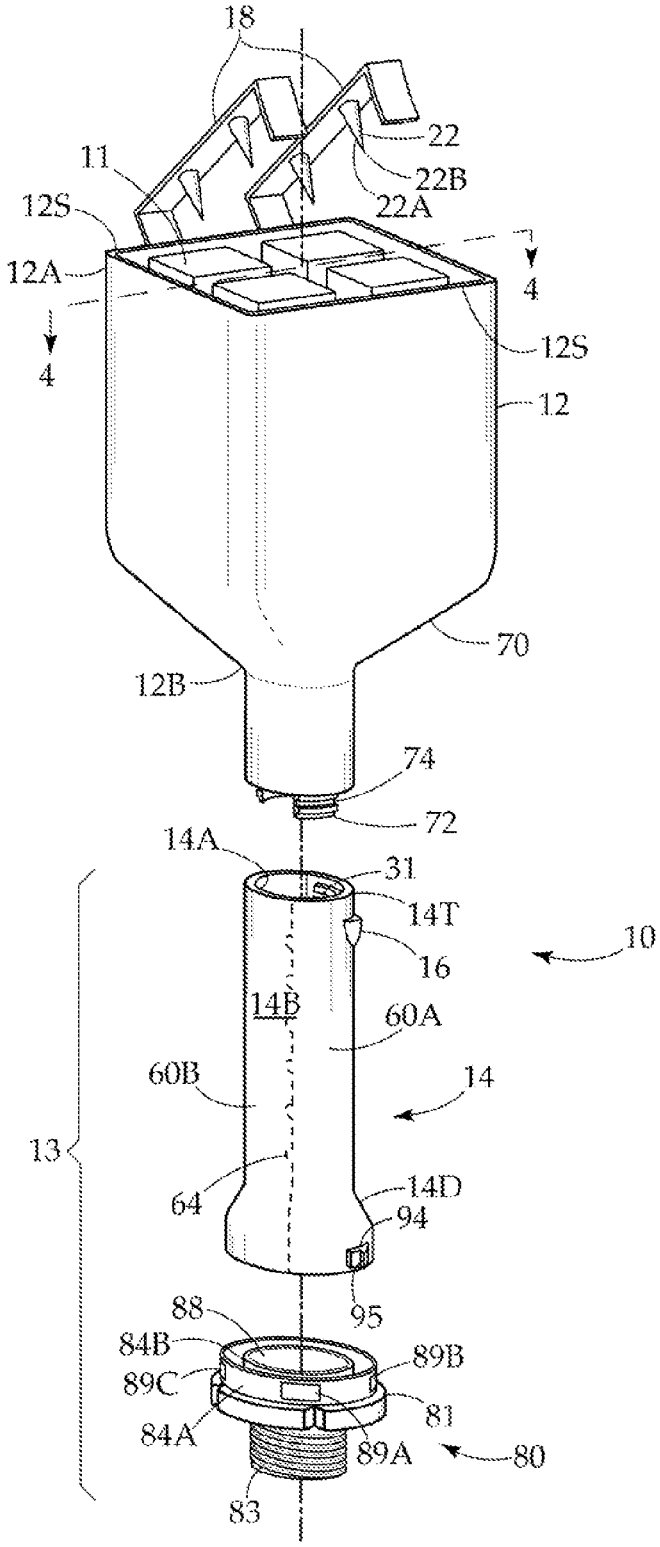
FIG. 1 is a diagrammatic perspective view of a multipurpose funnel system of the present invention having a bottle cartridge which interlocks with an interchangeable funnel comprised of a downspout and cap.

FIG. 1 illustrates a multipurpose funnel system 10 of the present invention for filling a container, wherein the system 10 prevents overflow during filling, is self venting and is capable of filling hard to reach container locations.

The funnel system 10 includes an interchangeable bottle cartridge 12, having a bottom end 12B and an open top end 12A and a removably coupled and interchangeable funnel 13. The funnel 13 is made up of a downspout 14 and a cap 80. The bottle cartridge 12, as shown, has the capacity to hold four one quart bottles of liquid therein, preferably oil, simultaneously, in an inverted position for vertically placed oil fill entrances on valve covers. The bottle cartridge 12 is available in many different sizes, depending on the need of the user. A cartridge capable of holding one to four twenty ounce bottles, one to eight one quart bottles, and one or more gallon bottles is all contemplated. In particular, a cartridge for holding one to four twenty ounce bottles of oil is utilized for any and all small engines, generators, yard tractors, garden tractors, and farm tractors, as well as for any and all size industrial machines, including but not limited to forklifts, bulldozers, earth moving equipment, military equipment, tanks, airplanes, any and all off road vehicles, motorcycles, power sport equipment, and road construction equipment. Any type of engine or motor that uses oil regardless of size is contemplated by the present invention to have a funnel specifically designed to attach to the oil fill location whether it be tabs, threads, slots, pressure fit, and any and all other configurations for allowing stationary placement of a funnel for oil filling regardless of application. Some applications will have a single funnel that will have a bottle cartridge holding one or more bottles based on application, a vented downspout, stability ring above threaded tip to rest against the mouth of the oil fill location regardless of size of motor or engine for any and all applications ranging from one hp to the highest hp rated motor or engine that requires oil for operation.

Most commonly, one for holding four 1 quart bottles of oil used in automotive, marine and diesel engine use; and another configuration preferably for holding four 20 ounce bottles of oil for small engines. Alternate configurations include a cartridge that holds 1 quart bottles up to and beyond 1 gallon bottles, and a cartridge that holds two gallon bottles of oil.

The bottles 11 of liquid utilized by the present invention are secured in position within the bottle cartridge 12. The open top end 12A of the bottle cartridge 12 has opposing sides 12S. A pair of parallel rods 18, preferably metal, are hingedly connected along one side 12S of the cartridge 12. The rods 18 hinge closed across the open top end 12A and snap into a locking position at the opposing side 12S.

Figure 4:
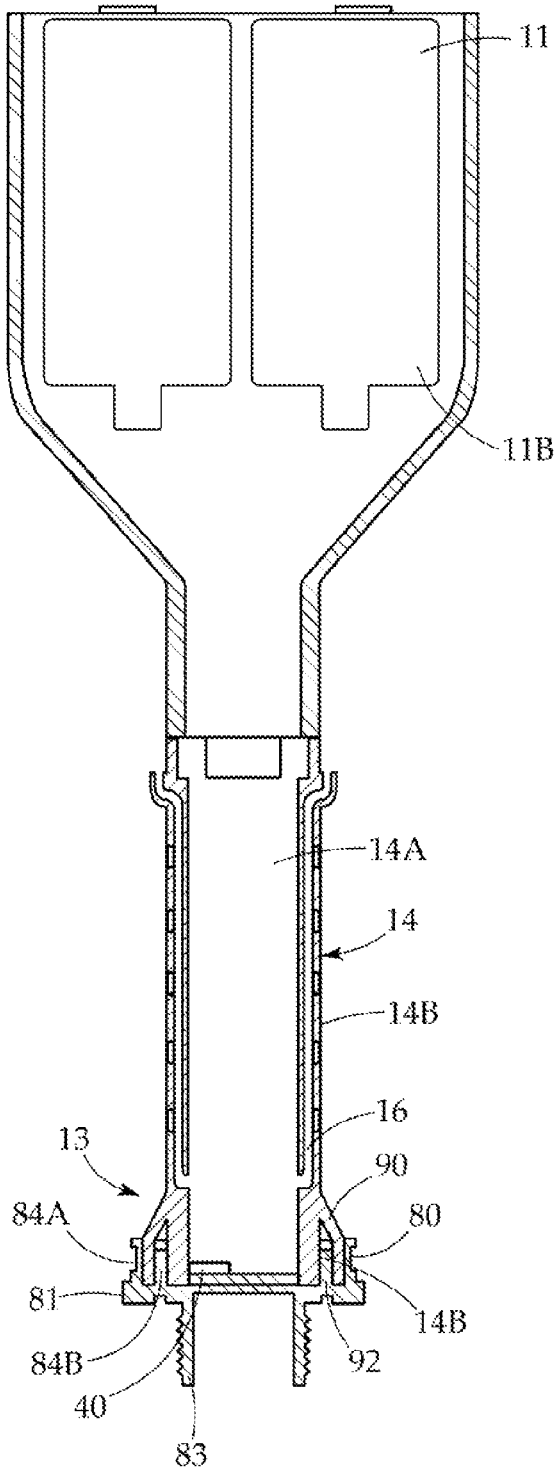
FIG. 4 is a cross-sectional view of the multipurpose funnel system of the present invention taken generally on line 4-4 of FIG. 1, wherein the bottom end of the downspout is securely locked in position within the cap.

As shown in FIG. 1, the rods 18 each include two hollow cone shaped spikes 22, preferably metal, extending outwardly therefrom. The spikes 22 vary in size and quantity depending on the application. For example, an earth moving equipment application may require larger hollow metal spikes 22 for venting. The spikes 22 have a top end 22A and pointed tip 22B. The top end 22A is preferably about one-quarter inches in diameter and tapers down to the pointed tip 22B which is preferably one-eighth inch offset. At least four inverted bottles 11 of oil, having a bottom end 11B, are inserted within the bottle cartridge 12 bottom end 11B facing upwardly, as shown in FIG. 4. The pointed tips 22B assist in puncturing the bottom ends 118 of the inverted bottles 11. This allows air to flow therein which then pushes oil downwardly with the help of gravity.

The bottle cartridge 12 is removably connected to the downspout 14 of the funnel 13, but is fully enclosed while connected with the bottle cartridge 12, thereby preventing spillage. The bottom end 12B of the bottle cartridge 12 has a tapered regress 70 integrally coupled to a pair of downwardly extending interlocking tabs 72. The interlocking tabs 72 are opposite one another and extend downwardly from the tapered regress 70. Each interlocking tab 72 includes a plurality of threaded grooves 74.

The downspout 14 of the funnel 13 has an inside surface 14A, an exterior wall 14B, a top end 14T and a bottom end 14D. In an alternate embodiment, the downspout 14 is comprised of two halves, including a first half 60A, shown in FIG. 2, having a plurality of evenly spaced male protrusions 62, and a second half 60B having a plurality of evenly spaced female accepting grooves 64. The first and second halves 60A and 60B integrally couple together when the corresponding male protrusions 62 are inserted and lock within the female accepting grooves 64, shown in FIG. 1. The first half 60A of the downspout 14 further includes a flat semi-circular plate 61 at the bottom end 14D perpendicular to the inside surface 14A such that one half of the bottom opening of the downspout 14 is enclosed.

Figure 2:
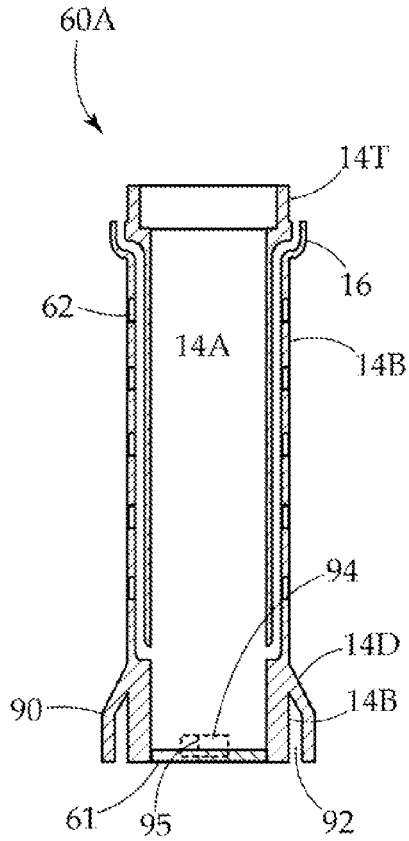
FIG. 2 is a cross-sectional view of the first half of the downspout of the present invention, having a plurality of male protrusions, an outwardly extending fin, at least two venting tubes, and a semi-circular plate.

In the preferred embodiment, the downspout 14, shown in FIGS. 1, 2 and 4, is shaped like a substantially elongated cylinder. Preferably, the downspout 14 is defined by one entirely integrated cylindrical member, rather than two attaching halves as discussed supra. The bottom end 14D of the downspout 14 includes an outwardly extending fin 90 which hides the exterior wall 14B near the bottom end 14D of the downspout 14. A hollow circular ring of space 92 is created between the exterior wall 14B of the downspout 14 and the fin 90. A locking tab 94, shown in FIG. 2, extends outwardly from the exterior wall 14B into the hollow circular ring 92 at the bottom end 14D of the downspout 14. The locking tab 94 is a substantially rectangular tapered tab, having a locking edge 95 hidden from outside view because the fin 90 extends outwardly thereover.

The downspout 14 is vented by a plurality of venting tubes 16 shown in FIG. 4. In the preferred embodiment, there are at least two venting tubes 16 oppositely spaced adjacent the exterior wall 14B of the downspout 14. The tubes 16 each extend upwardly along the exterior wall 14B of the downspout 14 from near the fin 90 to the top end 14T of the downspout 14. Alternatively, they may be along the inside surface 14A of the downspout 14 or both. The venting tubes 16 are integrated into the downspout 14 in order to allow the air to escape therefrom, which prompts a faster flow of liquid. Specifically, air contained within downspout 14 is pushed upwardly and outwardly through the tubes 16 along the exterior wall 14B, and is vented at the top end 14T of the downspout 14. This allows liquid within the downspout 14 to drain significantly faster.

The top end 14T of the downspout 14 has a pair of oppositely spaced threaded notches 31 for accepting the threaded grooves 74 of the tabs 72 of the bottle cartridge 12 therein. Such that a user inserts the interlocking tabs 72 of the bottle cartridge 12 into the top end 14T of the downspout 14 and turns the bottle cartridge 12 ninety degrees clockwise, allowing the threaded notches 31 of the downspout 14 to accept and lock in position with the threaded grooves 74 of the tabs 72, thereby securing the bottle cartridge 12 onto the downspout 14.

The bottle cartridge 12 and funnel 13 are easily replaced and interchanged as desired. Preferably, the bottle cartridge 12 and funnel 13 are designed in different shapes, sizes and configurations in a plurality of different manners but due to a standardization of threaded grooves 74 and threaded notches 31 are always easily and conveniently interchangeable.

Figure 3:
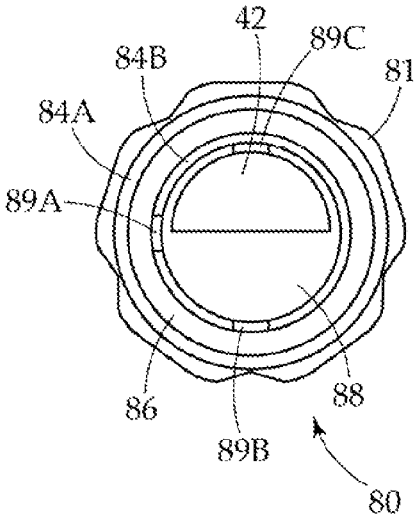
FIG. 3 is a top plan view of the cap of the funnel of the present invention, having a curved outwardly extending lip, a substantially circular hollow housing defined by a pair of upwardly extending walls, an outer wall having three substantially rectangular openings, and a semi-circular plate.

FIGS. 1 and 3 illustrate the substantially circular cap 80 which includes a curved outwardly extending lip 81 and an integrally coupled elongated screw tip 83 extending downwardly therefrom. The lip 81 provides a means for grasping and threading or unthreading the cap 80 into a valve cover or oil fill location. The lip serves to provide a grasping means for tightening and loosening the cap 80. The lip 81 extends outwardly perpendicular to outer wall 84A and screw tip 83. In alternate embodiments, the lip 81 can extend outwardly and turns at a ninety degree angle for providing an off valve cover to the oil fill location which has increased vertical stability. The cap 80 includes a substantially circular hollow housing 88 defined by a pair of upwardly extending walls 84. Specifically, an outer wall 84A and an inner wall 84B create a hollow circular ring of space 86, which accepts the fin 90 of the downspout 14 when connected to the cap 80. When connected, the inner wall 84B is accepted within the hollow circular ring of space 92 created between the exterior wall 14B of the downspout 14 and the fin 90. A flat semi-circular plate 42 is positionable within the hollow housing 88, perpendicular to the inner wall 84B such that one half of the hollow housing 88 is enclosed. The outer wall 84A includes three substantially rectangular openings 89, including a first opening 89B, a second opening 89A and a third opening 89C. The openings 89 act as a stop against the locking edge 95 of the locking tab 94, when inserted in position therein.

The elongated tip 83 of the cap 80 is threaded and commonly accepted by being screwed onto the container being filled, preferable onto an engine block. Preferably, the threading on the elongated tip 83 corresponds with threading on a factory dip stick or oil cap. Preferably, the threading extends the entire length of the elongated tip 83, thereby allowing the exterior lip 81 to provide stability. While in use, the lip 81 rests against the container being filled, which in this preferred embodiment, is an engine block. The lip 81 provides vertical stability thereby preventing the funnel 13 from falling over. Each year, make and model of automobile will include a specifically designed threaded cap 80, which in the preferred embodiment is interchangeable with the downspout 14. Regardless of the year, make and model of the automobile, each cap 80 will be designed in accordance with original factory oil cap specifications, thereby allowing it to thread into the valve cover regardless of threading style.

FIGS. 2, 3 and 4 illustrate an improved check valve mechanism 40 having three positions including an open, close, and intermediate position. The check valve mechanism 40 controls the flow of liquid through the funnel 14. The check valve mechanism 40 includes the flat semi-circular plate 42 positioned within the cap 80 that works in conjunction with the corresponding semi-circular plate 61 on the first half 60A of the downspout 14. In the open position, both plates 42 and 61 are vertically aligned on top of one another, thus creating a complete semicircular opening that extends through the cap 80, thereby allowing liquid to quickly flow from the cartridge 12 through the funnel 13. In the intermediate position, both plates 42 and 61 align to bisect one another, thus creating a one-quarter opening (specifically, one-half of the semi circular opening) which allows liquid to flow more slowly through the one-quarter opening from the cartridge 12 through the funnel 13. In the closed position (shown in FIG. 1), the plates 42 and 61 are juxtaposed substantially adjacent one another, such that a complete covering is created and liquid is prohibited from flowing through the cap 80 of the funnel 13.

When the fin 90 of the downspout 14 is sandwiched between the walls 84 of the cap 80, the downspout 14 and cap 90 are able to lock together. Specifically, the downspout 14 is rotated until the locking rectangular tab 94 and locking edge 95 springs out from one of the desired openings 89 of the outer wall 84A of the cap 80. The opening 89 acts as a stop, securing the locking edge 95 therein. Securing the tab 94 within each of the openings 89 creates the positions for the check valve mechanism 40. In particular, when the tab 94 is locked into the first opening 89B then the semi-circular plate 42 of the cap 80 and semi-circular plate 61 of the first half 60A of the downspout 14 are vertically aligned and the semicircular opening allows the quick flow of liquid. When the tab 94 is locked into the second opening 89A then the plates 42 and 61 bisect one another and only allow for the slow flow of liquid through a one-quarter opening. When the tab 94 is locked into the third opening 89C then the plates 42 and 61 are substantially horizontally aligned to completely close the cap 80 and stop of the flow of liquid therethrough. By rotating the cap 80 the user can adjust the position of the locking tab 94 and control the check valve mechanism 40 thereby influencing the speed and flow of liquid through the funnel 13.

In use, filling the container with liquid, a user first places the inverted bottles 11 of liquid securely within the bottle cartridge 12 by accepting the interlocking tabs 72 of the cartridge 12 within the corresponding notches 31 of the downspout 14. Next, the user secures the bottles 11 in position by closing the parallel rods 18 across the open top end 12A of the bottle cartridge 12 and locking said rods 18 in position. The flow of liquid is increased by gravity as spikes of the rods puncture the bottom ends of the bottles allowing air to flow through the hollow spikes. The user then inserts the elongated tip 83 of the funnel 13 into the container, even if the container is hard to reach because it is at an unusual angle. The lip 81 provides the user a means for grasping and threading or unthreading the cap 80 into the oil fill location. The system 10 is stabilized by allowing the lip 81 of the cap 80 to rest against the container. Spillage and flow is controlled by the check valve mechanism 40 within the cap 80 which controls the flow of liquid based on the position of the downspout 14 and cap 80. Liquid is poured into the container by locking the tab 94 into the second or third opening 89A or 89C of the cap 80. In one of these positions, the plates 42, 61 are aligned such that an opening is created for allowing liquid to flow through the downspout 14 and cap 80. Closing off the flow of liquid is actuated by locking the tab 94 into the first opening 89B along the cap 80 and allowing the plates 42, 61 to stop the flow of liquid.

The system 10 starts off fully closed with both plates 42, 61 substantially horizontally aligned with the locking tap 94 in the first opening 89B or the closed position. The downspout is then rotated clockwise to the next position with the plates 42, 61 defining a one-quarter opening (or one-half a semi-circular opening) with the locking tab 94 in the second opening 89A or intermediate position. The downspout is then rotated clockwise to the next position with the plates 42, 61 defining a complete opening (or full semi-circular opening) with the locking tab 94 in the third opening 89C or open position.

There are additional embodiments of the present invention contemplated which regarding unique and new ways for coupling the funnel system 10 to a variety of different systems, include, but are not limited to, small engines, outdoor power equipment, motorcycles, boats, marine engines, farm equipment, automotive, diesel and aerial engines. Each of the embodiments may be used on the funnel system 10 containing the check valve mechanism 40, or the funnel system 10 without the mechanism 40.

In conclusion, herein is presented an improved multipurpose funnel system. The invention is illustrated by example in the drawing figures, and throughout the written description. It should be understood that numerous variations are possible, while adhering to the inventive concept. Such variations are contemplated as being a part of the present invention.

What is claimed is:

1. A multipurpose funnel system, comprising:

an interchangeable funnel including a substantially elongated cylindrical downspout, a circular cap and a check valve mechanism having a pair of corresponding semi-circular plates, wherein said downspout includes an inside surface, an exterior wall, a top and bottom end, and at least two integrated venting tubes oppositely spaced adjacent said exterior wall of the downspout, said top end having a pair of oppositely spaced threaded notches, said bottom end having an outwardly extending fin thereby defining a hollow circular ring of space between said fin and said exterior wall of said downspout at said bottom end, said downspout having a tapered locking tab extending outwardly from said exterior wall into said hollow circular ring having a locking edge, wherein said inside surface at said bottom end includes one of said flat semi-circular plates of said check valve mechanism extending perpendicularly outward therefrom;

wherein said cap having a substantially circular hollow housing defined by a pair of walls, including an inner wall and an outer wall defining a hollow circular ring of space therebetween, said cap having a curved outwardly extending lip and an integrally coupled elongated threaded tip extending downwardly therefrom, said cap having one of said flat semi-circular plates of said check valve mechanism extending perpendicularly from said inner wall into said hollow housing such that one half of said housing is enclosed, wherein said outer wall includes three substantially rectangular openings which independently accept said locking tab of said fin to define an open, intermediate, and close position of said control valve mechanism;

wherein said fin of said downspout is accepted between said walls of said cap, and said interlocking tab of said fin of said downspout is secured within one of said rectangular openings of said outer wall to define said funnel;

an interchangeable bottle cartridge removeably couples to said top end of said downspout of said funnel and having a bottom end and an open top end having opposing sides, said bottom end of said cartridge having a tapered regress integrally coupled to a pair of downwardly extending interlocking tabs corresponding to said notches of said downspout of said funnel for accepting said interlocking tabs of said bottle cartridge therein; and a pair of parallel rods hingedly connect along one side of said bottle cartridge and close across said open top end before locking at said opposing side, having at least one hollow cone shaped spike extending outwardly therefrom and each said spike having a top end and pointed tip.

2. The multipurpose funnel system of claim 1, wherein the downspout further comprises a first half and a second half wherein the first half of the downspout includes a plurality of evenly spaced male protrusions and the second half of the downspout includes a plurality of corresponding evenly spaced female accepting grooves, such that the first and second halves integrally couple together when the corresponding male protrusions are locked into the female accepting grooves.

3. The multipurpose funnel system of claim 2, wherein the first half of the downspout includes the flat semi-circular plate of the check valve mechanism, wherein said plate is positionable at the bottom end of the first half of the downspout perpendicular to the inside surface such that one half of the downspout is enclosed.

4. The multipurpose funnel system of claim 1, wherein the lip extends outwardly perpendicular to the outer wall and screw tip and turns at a ninety degree angle for providing an off valve cover with increased vertical stability.

5. A multipurpose funnel system, comprising:

a funnel including a downspout, a cap and a check valve mechanism having a pair of corresponding semi-circular plates, wherein said downspout includes an inside surface, an exterior wall, a top and bottom end, said bottom end having an outwardly extending fin thereby defining a hollow circular ring of space between said fin and said exterior wall of said downspout at said bottom end, a locking tab extending outwardly from said exterior wall into said hollow circular ring having a locking edge, wherein said inside surface at said bottom end includes one of said flat semi-circular plates of said check valve mechanism extending perpendicularly outward therefrom;

wherein said cap having a substantially circular hollow housing defined by a pair of walls, including an inner wall and an outer wall, said cap having one of said flat semi-circular plates of said check valve mechanism extending perpendicularly from said inner wall into said hollow housing such that one half of said housing is enclosed, wherein said outer wall includes three substantially rectangular openings which independently accept said locking tab of said fin to define an open, intermediate, and close position of said control valve mechanism;

wherein said fin of said downspout is accepted between said walls of said cap, and said interlocking tab of said downspout is secured within one of said rectangular openings of said outer wall of said cap to define said funnel;

a bottle cartridge removeably couples to said top end of said downspout of said funnel and has a bottom end and an open top end having opposing sides; and at least one rod hingedly connected along one side of said bottle cartridge and closing across said open top end before locking at said opposing side, having at least one hollow cone shaped spike extending outwardly therefrom.

6. The multipurpose funnel system of claim 5, wherein the funnel and bottle cartridge are interchangeable.

7. The multipurpose funnel system of claim 5, wherein the top end of the downspout of the funnel has a pair of oppositely spaced threaded notches and the bottom end of the bottle cartridge has a tapered regress integrally coupled to a pair of downwardly extending interlocking tabs having threaded grooves, wherein the tabs of the cartridge secure within the notches of the downspout of the funnel for attaching the cartridge to the funnel.

8. The multipurpose funnel system of claim 5, wherein a plurality of integrated venting tubes are evenly spaced adjacent the outside wall of the downspout.

9. The multipurpose funnel system of claim 5, wherein each spike has a top end and pointed tip.

10. The multipurpose funnel system of claim 5, wherein the cap has a curved outwardly extending lip and an integrally coupled elongated threaded tip extending downwardly therefrom.

11. The multipurpose funnel system of claim 5, wherein the downspout includes a first half and a second half.

12. The multipurpose funnel system of claim 11, wherein the first half of the downspout includes a plurality of evenly spaced male protrusions and the second half of the downspout includes a plurality of corresponding evenly spaced female accepting grooves, such that the first and second halves integrally couple together when the corresponding male protrusions are locked into the female accepting grooves.

13. The multipurpose funnel system of claim 12, wherein the first half of the downspout includes the flat semi-circular plate of the check valve mechanism, wherein said plate is positionable at the bottom end of the first half of the downspout perpendicular to the inside surface such that on half of the downspout is enclosed.

14. The multipurpose funnel system of claim 5, wherein the lip extends outwardly perpendicular to the outer wall and screw tip and turns at a ninety degree angle for providing an off valve cover with increased vertical stability.

* * * * *